US007682764B2

(12) United States Patent
Fujiwara et al.

(10) Patent No.: US 7,682,764 B2
(45) Date of Patent: Mar. 23, 2010

(54) RESIN COATED CARRIER FOR ELECTROPHOTOGRAPHY AND TWO-COMPONENT DEVELOPER FOR ELECTROPHOTOGRAPHY MADE THEREFROM

(75) Inventors: Akira Fujiwara, Shizuoka (JP); Yoshiaki Harada, Shizuoka (JP)

(73) Assignee: Tomoegawa Paper Co., Ltd, Tokyo (JP)

( * ) Notice: Subject to any disclaimer, the term of this patent is extended or adjusted under 35 U.S.C. 154(b) by 1018 days.

(21) Appl. No.: 11/108,745

(22) Filed: Apr. 19, 2005

(65) Prior Publication Data

US 2005/0233239 A1 Oct. 20, 2005

(30) Foreign Application Priority Data

Apr. 20, 2004 (JP) ..... 2004-123732

(51) Int. Cl.
*G03G 9/113* (2006.01)

(52) U.S. Cl. ..... 430/111.33; 430/111.32; 430/111.35; 430/111.41

(58) Field of Classification Search ..... 430/111.35, 430/111.32, 111.33
See application file for complete search history.

(56) References Cited

U.S. PATENT DOCUMENTS

| | | | | |
|---|---|---|---|---|
| 5,432,033 | A * | 7/1995 | Asanae et al. | 430/35 |
| 5,496,673 | A * | 3/1996 | Saitoh et al. | 430/111.3 |
| 5,716,752 | A * | 2/1998 | Ott et al. | 430/137.18 |
| 6,143,456 | A * | 11/2000 | Silence et al. | 430/111.32 |
| 6,245,474 | B1 | 6/2001 | Hsu et al. | |
| 6,416,916 | B1 * | 7/2002 | Silence et al. | 430/111.4 |
| 2002/0081514 | A1 | 6/2002 | Ohba et al. | |
| 2003/0186154 | A1 | 10/2003 | Suzuki et al. | |
| 2004/0234876 | A1 * | 11/2004 | Suzuki et al. | 430/97 |
| 2006/0222994 | A1 * | 10/2006 | Maniar et al. | 430/111.35 |

FOREIGN PATENT DOCUMENTS

| | | | |
|---|---|---|---|
| EP | 0 703 503 | A1 | 3/1996 |
| EP | 1 205 814 | A1 | 5/2002 |
| EP | 1 260 874 | A1 | 11/2002 |
| JP | 58-123552 | A | 7/1983 |
| JP | 3-31860 | A | 2/1991 |
| JP | 04-329553 | A * | 11/1992 |
| JP | 8-234501 | A | 9/1996 |
| JP | 2001-92190 | A | 4/2001 |
| JP | 2001-154416 | A | 6/2001 |
| WO | WO 2004088680 | A2 * | 10/2004 |
| WO | WO 2005048276 | A2 * | 5/2005 |

* cited by examiner

*Primary Examiner*—Christopher RoDee
(74) *Attorney, Agent, or Firm*—Arent Fox LLP

(57) ABSTRACT

A resin coated carrier for electrophotography and a two-component developer for electrophotography made therefrom, in which electrostatic charge giving ability to toner is high, anti-spent property is superior, charging property is stable even if a large number sheets are continuously printed, initial electrostatic charge increasing ability and electrostatic charge maintaining ability after leaving are also superior, and fogging at supplying toner and fogging after leaving are not generated. In a resin coated carrier for electrophotography comprising a coating material and a core material, in which the coating material covers the surface of the core material, the coating material contains a resin component and a conductive agent, the core material is ferrite, and electric resistance of the carrier at an applied voltage of 100 V set to be $1.0\times10^3$ to $1.0\times10^6$ Ω·cm, or breakdown voltage is set to be 120 to 280 V.

3 Claims, 1 Drawing Sheet

RESIN COATED CARRIER FOR ELECTROPHOTOGRAPHY AND TWO-COMPONENT DEVELOPER FOR ELECTROPHOTOGRAPHY MADE THEREFROM

BACKGROUND OF THE INVENTION

1. Field of the Invention

The present invention relates to a resin coated carrier for electrophotography and to a two-component developer for electrophotography made therefrom.

2. Related Art

Two-component developers used in an electrophotographic system are composed of a toner and a carrier. The carrier has a function which yields triboelectric charge and gives desired charge to the toner, by mixing and stirring with the toner in a developing tank and which forms a toner image by transferring the charged toner to an electrostatic latent image on a photoconductor. Then, the carrier is repeatedly used by returning from the surface of a magnet roll to the inside of the developing tank and by mixing and stirring with newly supplied toner again.

Therefore, the carrier is required to provide the toner with properties which are always desired under all environments for the entire using period, and in particular, to provide it with stable charging properties.

However, conventional two-component developers have spent phenomenon in which toner adheres on the surface of carrier by stress such as collision of carriers in stirring, friction between a developing tank and carriers, or the like. In order to prevent the carrier from deteriorating by the spent phenomenon, various resins have ever been applied on the surface of core particles. When the surface of the core particle is covered with resin, since the surface of the carrier is made to be smooth, it is difficult to adhere the toner to the carrier, and it is also difficult for the spent phenomenon to occur. Therefore, the life of the developer can be extended. Furthermore, charging characteristics and electric resistance of the carrier, etc., can be controlled by selecting the resin.

In addition, since the core particle does not directly receive influence of the environment by being covered with the resin, it is difficult to change characteristics of the carrier to environmental conditions such as temperature change, humidity change, etc.

Thus, practical use is drastically improved when the surface of the core particle of the carrier is covered with the resin.

As a resin which covers the surface of the core particle, silicone resins, silicone grafted resins, acrylic resins, styrene resins, urethane resins, epoxy resins, polyamide resins, polyester resins, acetal resins, polycarbonate resins, phenol resins, vinyl resins (vinyl chloride resin, polyvinyl acetate, etc.), cellulose resins, polyolefin resins, styrene-acrylic copolymer resins, styrene-butadiene copolymer resins, rosin resins, fluorided acrylic resins, fluororesins, etc., can be used. The resins have been used alone, as mixed resins, or as copolymer resins of a monomer component thereof.

However, in resin coated carriers produced by the above conventional techniques, peeling or falling out of coated resin film, etc., occurs on the surface of the carrier by stress described above, and characteristics of the carrier such as electrostatic charging amount, carrier resistance, etc., are deteriorated by these phenomena, and there are problems that degradation of image (changing of image density, generation of background fogging in image, etc.) and dusting of toner are generated. In particular, in the case in which the carrier is used under severe conditions such as the case in which strong stirring is required in order to quickly increase electrostatic charge, or the case in which long life is required, the problem that the coated resin film peeling is remarkable. When film strength and abrasion resistance of the coated resin are not sufficient, since the film is inferior in mechanical shock, the film is worn and broken by collision between particles and collision with developing members in the passage of time, and the coated resin peeled from the surface of the carrier is mixed and accumulated in developer. When the coated resin film peels, electric resistance on the surface of the carrier partially changes and sufficient triboelectric charge is not obtained on the toner, and as a result, image concentration is decreased and fogging is generated in the image background. Furthermore, since the peeled coated resin often has high polarity, there are problems that it adheres to toner and to a developing unit, that it adheres to the surface of a photo conductor and background contamination (fogging) and uneven streaks are generated on the image, and that triboelectric charging characteristics of the developer is changed and quality of the image is deteriorated, etc. In a word, in the resin coat carriers made by conventional techniques, there are problem that electrophotographic characteristics are easily affected by peeling of the resin film generated by stress.

In addition, electrostatic charge maintaining ability after leaving is also important, because the developer is left after charging and it is used again. When the electrostatic charge maintaining ability is too low, electrostatic charge is decreased during leaving, and fogging is generated in resuming printing.

As a representative resin used as the coated resin, acrylic resins and silicone resins are mentioned.

The acrylic resin has high adhesive strength to the carrier core material and peeling is unlikely to occur. The acrylic resin coated carrier is superior in electrostatic charge giving ability to the toner, in particular, electrostatic charge giving ability to negative charge toner, and it is used widely; however, there are disadvantages in which anti-spent property and electrostatic charge maintaining ability are inferior.

In addition, the silicone resin coated carrier has low surface energy, friction coefficient is also low, and anti-spent property is superior; however, there is disadvantage in which electrostatic charge giving ability is inferior. That is, the silicone resin coated carrier is inferior in electrostatic charge increasing ability, and fogging is easily generated when the toner is supplied. However, the fogging after leaving is difficult to generate since the electrostatic charge maintaining ability after leaving is superior.

As a resin coated carrier having both superior characteristics of these acrylic resin coated carrier and silicone resin coated carrier, acrylic modified silicone resin coated carriers and silicone modified acrylic resin coated carriers are proposed (Japanese Unexamined Patent Application Publications Nos. H3-31860, H8-234501, and 2001-92190).

However, in the case in which the problem of peeling of the resin film is included, it is not easy to resolve the above problems well, even if the resins for coating are selected.

Additionally, as a core material in the resin coated carrier, ferrite or magnetite is mainly used (Japanese Unexamined Patent Application Publication No. 2001-154416).

The magnetite has generally high saturation magnetization, and it is advantageous for adhering carrier to a photoconductor; however, the stress is large in developing and degradation of the developer is rapid, and there is a problem that durability of the developer is inferior. In addition, it is difficult to obtain a high definition image, since the saturation magnetization is generally high.

Furthermore, the carrier is used as a two-component developer by combining with the toner. Therefore, in order to demonstrate superior characteristics as a two-component developer, characteristics of the toner are also important, and it is desirable that superior triboelectric charging ability, etc., as a developer be had by suitably combining with the toner which conform to characteristics of the carrier.

DISCLOSURE OF INVENTION

It is an object of the present invention to provide a resin coated carrier for electrophotography and a two-component developer for electrophotography made therefrom, in which electrostatic charge giving ability to toner is high, anti-spent property is superior, charging property is stable even if a large number of sheets is continuously printed, initial electrostatic charge increasing ability and electrostatic charge maintaining ability after leaving are also superior, and fogging at supplying toner and fogging after leaving are not generated. In addition, it is also an object of the present invention to provide a resin coated carrier for electrophotography and a two-component developer for electrophotography, in which the above characteristics are further improved by reducing the influence of peeling of a resin film.

A resin coated carrier for electrophotography of the present invention is characterized in that a coating material which contains a resin component and a conductive agent covers on the surface of core material which is ferrite, wherein electric resistance at applied voltage of 100 V is $1.0\times10^3$ to $1.0\times10^6$ Ω·cm. In addition, a resin coated carrier for electrophotography of the present invention is characterized in that coating material which contains the resin component and conductive agent covers the surface of core material which is ferrite, wherein breakdown voltage is 120 to 280 V.

Furthermore, a resin coated carrier for electrophotography of the present invention is characterized in that coating material which contains a silicone component and an acrylic component covers the surface of core material which is ferrite, wherein electric resistance at an applied voltage of 100 V is $1.0\times10^3$ to $1.0\times10^6$ Ω·cm. In addition, a resin coated carrier for electrophotography of the present invention is characterized in that a coating material which contains silicone component and acrylic component covers the surface of core material which is ferrite, wherein breakdown voltage is 120 to 280 V.

Additionally, a two-component developer for electrophotography of the present invention comprises the above resin coated carrier for electrophotography and toner which contains at least binder resin and colorant.

According to the present invention, a resin coated carrier for electrophotography and a two-component developer for electrophotography made therefrom, in which electrostatic charge giving ability to toner is high, anti-spent property is superior, charging property is stable even if a large number of sheets is continuously printed, initial electrostatic charge increasing ability and electrostatic charge maintaining ability after leaving are also superior, and fogging at supplying toner and fogging after leaving are not generated, can be provided. In addition, according to the present invention, by using toner for electrophotography which adheres magnetic powder to the surface of toner particle and the above resin coated carrier for electrophotography, a two-component developer for electrophotography in which initial electrostatic charge increasing ability is further improved, can be provided.

BEST MODE FOR CARRYING OUT THE INVENTION

Figure 1:
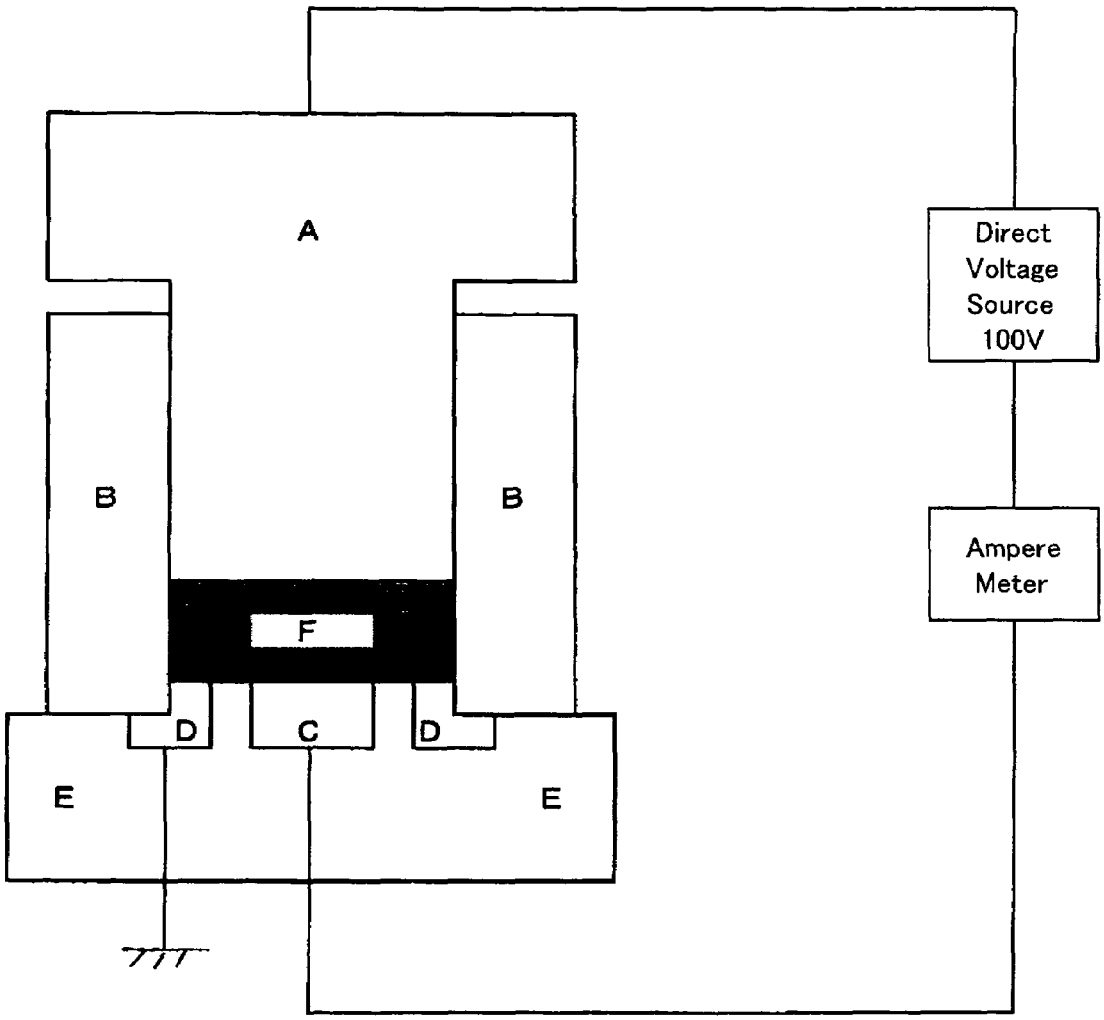
FIG. 1 is a schematic drawing showing an electric resistance measuring apparatus.

In the following, the present invention will be explained in detail.

The core material of the resin coated carrier of the present invention is ferrite, and saturation magnetization of ferrite is smaller than that of magnetite. When a resin coated carrier is formed, spent phenomena seldom occurs, stress in developing is smaller than that of magnetite, and as a result, a carrier having superior durability can be provided.

It is desirable that the ferrite used in the present invention be magnesium ferrite of which electric resistance is low. Ferrite containing heavy metal such as Cu, Zn, Mn, etc., generally has high electric resistance of $3.5\times10^7$ to $2.0\times10^9$ Ω·cm, and in contrast, magnesium ferrite has low electric resistance of $6.5\times10^3$ to $5.0\times10^5$ Ω·cm. When magnesium ferrite is used as a core material in a resin coated carrier having low resistance like in the present invention, difference of electric resistance by existence of a coated film can be remarkably reduced. Therefore, since the change of charging properties can be reduced, even if a little peeling is generated on the coated film, magnesium ferrite is particularly preferable.

In addition, the magnesium ferrite is desirable also in view of environmental protection because heavy metals such as Cu, Co, Zn, Mn, Cr, Pb, etc., are not contained.

The magnesium ferrite contains iron and magnesium as a main metal element component and basically does not contain other metal element components. It is desirable that the total content of the other metal elements be 2.0 weight % or less, it is more desirable that it be 1.5 weight % or less, and it is most desirable that it be 1.0 weight % or less.

It is desirable that the content of magnesium in the magnesium ferrite be 0.5 to 10.0 weight %, it is more desirable that it be 1.0 to 6.0 weight %, and it is most desirable that it be 1.5 to 4.0 weight %. When the content of magnesium is not more than 0.5 weight %, saturation magnetization is increased and stress in developing is increased, and as a result, it is not desirable. In contrast, when the content exceeds 10 weight %, saturation magnetization is decreased, carrier is easily adhered to a photoconductor, and as a result, it is not desirable.

The content of elements which constitutes the magnesium ferrite can be measured by well-known methods, and in the present invention, it was measured by Energy Dispersible X-ray diffractometer: EDX (trade name: EMAX-7000, produced by HORIBA, Ltd.).

In the present invention, it is preferable that silicone component and acrylic component be contained as a resin which covers the core material. That is, silicone resin, acrylic resin, silicone modified acrylic resin, acrylic modified silicone resin, etc., can be used by mixing properly; however, the present invention is not limited to them.

It is desirable that weight ratio of silicone component and acrylic component be 50:50 to 90:10, and it is more desirable that it be 55:45 to 85:15. When the silicone component is not more than 50 weight parts, electrostatic charge maintaining ability is insufficient, and fogging after leaving is easily generated. In contrast, when the silicone component exceeds 90 weight parts, increasing of electrostatic charge is not preferable, and fogging is easily generated at supplying toner. Additionally, it is unpreferable in the case in which conductive agent is added at 10 to 25 weight % to resin component, because strength of a coated film is decreased.

The silicone component has superior electrostatic charge maintaining ability and reduces surface tension and friction coefficient of a coating film, and therefore, it is difficult to generate spent phenomenon of toner on the surface of carrier. The silicone component is formed with a siloxane structure unit, and as a siloxane structure, a structure shown by the following chemical formula (1) can be mentioned. The silicone component may contain organo polysiloxane having a three-dimensional network structure in addition to a straight chain siloxane structure. Of these, dimethylsiloxane and methylphenylsiloxane can be preferably used. In addition, the silicone component may be modified compounds including alkyd, urethane, epoxy, polyester, or acrylic structure, as necessary.

Chemical Formula 1

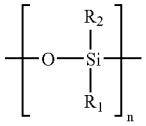

(1)

In the formula, $R_1$ and $R_2$ represent hydrogen atom, alkyl groups having one to four carbon atoms, alkoxy groups having one to four carbon atoms, phenyl groups, phenoxy groups, alkenyl groups having two to four carbon atoms, alkenyloxy groups having two to four carbon atoms, hydroxyl groups, carboxyl groups, ethylene oxide groups, glycidyl groups, or —O—Si—$(R_3)_3$; $R_3$ represents hydroxyl groups, carboxyl groups, alkoxy groups having one to four carbon atoms, alkenyl groups having two to four carbon atoms, phenyl groups, or phenoxy groups; and n represents an integer 1 or more.

The acrylic component is a resin component in which a main unit is an acrylic monomer. As an acrylic monomer, well-known compounds can be applied, and for example, hydroxyl group including monomers such as 2-hydroxyethyl (metha)acrylate, 2-hydroxypropyl (metha)acrylate; (metha) alkyl acrylate esters with alkyl groups having one to eighteen carbon atoms such as methyl, ethyl, propyl, isopropyl, butyl, isobutyl, octyl, 2-ethylhexyl, lauryl, stearyl, and cyclohexyl ester; acrylic acids such as methacrylic acid; amide group including monomers such as (metha)acrylamide, N-methylol (metha)acrylamide, N-methoxymethyl (metha)acrylamide, N-butoxymethyl (metha)acrylamide, diacetone (metha)acrylamide; amino group including monomers such as dimethylaminoethyl (metha)acrylate, diethylaminoethyl (metha) acrylate; alkoxy group including monomers such as methoxyethyl (metha)acrylate, butoxyethyl (metha)acrylate; glycidyl group including monomers such as glycidyl (metha) acrylate; monomers which contains two radical polymerizable unsaturated groups or more in one molecule such as allyl (metha)acrylate, ethyleneglycol di(metha)acrylate, diethyleneglycol di(metha)acrylate, trimethylolpropane tri(metha) acrylate; (poly)oxyethylene chain including monomers such as (poly)oxyethylene mono(metha)acrylate having one to a hundred ethylene oxide groups; etc., can be used. Of these, hydroxyl groups including monomer and (metha)alkyl acrylate ester with alkyl groups having one to eighteen carbon atoms are preferable as a main component.

In the resin coated carrier of the present invention, it is preferable that electric resistance measured at applied voltage of 100 V be $1.0\times10^3$ to $1.0\times10^6$ Ω·cm, it is more preferable that it be $2.0\times10^3$ to $9.0\times10^5$ Ω·cm, and it is most preferable that it be $8.0\times10^3$ to $5.0\times10^5$ Ω·cm. When the electric resistance is not more than $1.0\times10^3$ Ω·cm, resistance is too small and electrostatic charge maintaining ability is decreased, and as a result, fogging after leaving is easily generated. In contrast, when it exceeds $1.0\times10^6$ Ω·cm, electrostatic charge increasing ability of toner is inferior, and as a result, fogging at supplying toner is easily generated.

In the following, a measuring method of electric resistance in the present invention is explained.

An outline of a measuring apparatus is shown in FIG. 1.

Measuring Method of Electric Resistance

1. A cylinder B (made of polytetrafluoroethylene, inside diameter: 2.35 cm) is set on a base E, and 5 g of carriers is put into the cylinder B and it is leveled.
2. An upper electrode A is inserted in the cylinder B, and carrier layer F is formed.
3. DC voltage of 100 V is applied between the upper electrode A and a main electrode C, current value at the time is read, thickness of the carrier layer F is measured, and electric resistance is calculated according to the following equation.

Electric Resistance=(Applied Voltage/Current Value)×(Cross Section of Main Electrode/Thickness of Carrier Layer)

Applied Voltage: 100 V, Cross Section of Main Electrode: 1.0 $cm^2$,

Thickness of Carrier Layer: (Measured Value) cm

Breakdown voltage of the resin coated carrier of the present invention is 120 to 280 V and is extremely small in comparison with conventional resin coated carriers in which breakdown voltage generally exceeds 300 V. When the breakdown voltage is not more than 120 V, it is easy that electric resistance at applied voltage of 100 V is not more than $1.0\times10^3$ Ω·cm and electrostatic charge maintaining ability is decreased, and as a result, fogging after leaving is easily generated. In contrast, when it exceeds 280 V, it is easy for electric resistance at an applied voltage of 100 V to exceed $1.0\times10^6$Ω·cm and electrostatic charge increasing ability with toner is deteriorated, and as a result, fogging at supplying toner is easily generated.

In the following, a measuring method of breakdown voltage is explained.

Measuring Method of Breakdown Voltage

After measuring of the electric resistance, applied voltage is increased by 10 V increments, and voltage at which current of 11 mA or more is conducted through the carrier layer between the upper electrode A and the main electrode C is measured as breakdown voltage.

In the resin coated carrier of the present invention, it is preferable that conductive agent be contained at 10 to 25 weight % to resin component in coating material, and it is more preferable that it be contained at 12 to 20 weight %, in order to adjust electric resistance, charging property, etc. When the content of the conductive agent is not more than 10 weight %, electric resistance easily exceeds $1.0\times10^6$ Ω·cm and electrostatic charge increasing ability with toner is decreased, and as a result, fogging at supplying toner is easily generated. In contrast, when it exceeds 25 weight %, it is easy for the electric resistance to be not more than $1.0\times10^3$ Ω·cm and electrostatic charge maintaining ability is decreased, and as a result, fogging after leaving is easily generated.

As a conductive agent, carbon black such as ketjen black, furnace black, acetylene black, channel black; white type conductive agents such as $TiO_2$, ZnO, $SnO_2$; etc., can be used. In particular, carbon black is preferably used, and $TiO_2$ is preferably used as a white type conductive agent.

A method for covering a core particle with resin for coating includes Step 1 of preparing coating material by selecting resin for coating; Step 2 of adhering the coating material to the surface of a core particle; Step 3 of forming a film by heating the resin for coating so as to harden; and Step 4 of heating the coated particle at higher temperature for longer time.

The coating material may be obtained by adding carbon black or magnetic powder, charge control agent, crosslinking agent, cross-link accelerator, curing agent or other additives to the resin for coating dissolved in solvent such as benzene, xylene, toluene, chloroform, trichloroethylene, trichloromethane, methylethylketone, hexane, tetrahydrofuran, as necessary, and by mixing and stirring using a mixing machine such as a mixer. In addition, the coating resin may be used as an emulsion.

A method for covering with coating material the surface of core particle is not limited to specific methods; however, it is necessary to form a uniform coated resin film, and for example, a fluidizing bed method can be used. In the fluidizing bed method, air flow is blown up from below a fluidizing tank; core particle group is held in a state of floating suspension; coating material is sprayed on the fluidized core particle group so that coating material is adhered to the surface of core particle; and the coating material is dried under a conditions selected so as to form a tackfree state. Generally, resin solution is sprayed in air at 200° C. or less, preferably 50 to 150° C., so as to quickly remove solvent. Then, resin coated carrier having a desired particle size can be obtained by sieving.

Furthermore, the resin coated carrier may be further heat-treated for 30 minutes to 24 hours at 20 to 50° C. higher temperature than the above heating temperature, as necessary.

In the present invention, it is preferable that the covering amount of the coating material to the total amount of the resin coated carrier be 0.3 to 2.0 weight %, and it is more preferable that it be 0.5 to 1.0 weight %. When the covering amount is less than 0.3 weight %, it is difficult for the coating material to uniformly cover the surface of the core material, and in contrast, when it exceeds 2.0 weight %, electrostatic charge giving ability with the toner is deteriorated and as a result, fogging at supplying toner is easily generated.

It is preferable that volume average particle diameter of the resin coated carrier of the present invention be 50 to 90 μm, it is more preferable that it be 60 to 80 μm, and it is most preferable that it be 65 to 75 μm. When the volume average particle diameter is not more than 50 μm, the carrier moves easily on the photoconductor, and in contrast, when it exceeds 90 μm, a magnetic brush touches with a photoconductor hardly and as a result, image quality is deteriorated.

The volume average particle diameter is measured using a particle size distribution measuring apparatus of laser diffraction style (trade name: Micro Track HRA9320-X100, produced by Nikkiso Co., Ltd.).

In the following, toner used in the two-component developer for electrophotography of the present invention is explained.

The toner used in the two-component developer for electrophotography of the present invention is a toner which contains at least binder resin and colorant.

The binder resin is not limited to a specific resin if it is used in usual toner, and for example, polystyrene resins, polyacrylate resins, styrene-acrylate copolymer resins, styrene-methacrylate copolymer resins, polyvinylchloride, polyvinyl acetate, polyvinylidene chloride, phenol resins, epoxy resins, polyester resins, hydrogenated rosin, polyolefin resins, cycloolefin copolymer resins, cyclized rubber, polylactic acid resins, terpene phenol resins, thermoplastic elastomers, etc., can be used alone or in combination.

The colorant of the toner used in the two-component developer for electrophotography of the present invention is not limited to specific colorant if it is used in a usual toner, and for example, carbon black, aniline blue, calco oil blue, chrome yellow, ultramarine blue, Dupont oil red, quinoline yellow, methylene blue chloride, phthalocyanine blue, malachite green oxalate, lamp black, rose bengal, etc., can be used.

The colorant must be contained at a sufficient ratio to form a visible image having sufficient image density, and for example, the content of colorant to binder resin of 100 weight parts is 1 to 20 weight parts and is preferably 1 to 10 weight parts.

The toner used in the two-component developer for electrophotography of the present invention preferably contains waxes having melting point of 60 to 160° C. in order to improve low-temperature fixability and releasability in fusing.

When the melting point is not more than 60° C., storage stability is inferior, and in contrast, when it exceeds 160° C., low-temperature fixability is inferior.

It is preferable that the content of wax to toner particle be 0.5 to 15 weight %, it is more preferable that it be 1 to 10 weight %, and it is most preferable that it be 1 to 7 weight %. When the content of wax is not more than 0.5 weight %, the low-temperature fixability is insufficient, and the releasability is also insufficient. In contrast, when it exceeds 15 weight %, there is a problem in the storage stability, and since the wax is easily separated from toner particles, carrier spent is produced.

As a wax, polyolefin waxes such as low molecular weight polyethylene, low-molecular weight polypropylene; synthesis waxes such as Fischer-Tropsch wax; petroleum wax such as paraffin wax, microcrystallin wax; carnauba wax, candelilla wax, rice wax, hardened castor oil, montan wax, higher fatty acid and ester thereof, fatty acid amide, etc., can be used.

The melting point of the wax is endothermic peak temperature measured by a differential scanning calorimetry (DSC), and it is measured according to ASTM: D3418-82 as described below.

5 mg of sample is measured and put in a cell made of aluminum, it is carried in a differential scanning calorimetry (DSC) (trade name: SSC-5200, produced by Seiko Instruments Inc.), and $N_2$ gas is flowed at 50 ml per 1 minute therein. Next, it is heated from 20 to 200° C. at a heating rate of 10° C. per 1 minute and is retained at 200° C. for 10 minutes, and then, it is cooled from 200° C. to 20° C. at a cooling rate of 10° C. per 1 minute. Subsequently, second temperature increasing is carried out under the same condition, and endothermic peak temperature at the time is measured as a melting point.

The toner used in the two-component developer for electrophotography of the present invention preferably contains charge control agents, as necessary. The charge control agent is added in order to give polarity to the toner particle, and it contains agent for positive charge toner and agent for negative charge toner, and the agents may be used in combination. As a charge control agent for positive charge toner, Nigrosine dyes, quaternary ammonium salts, pyridinium salts, azines, triphenylmethane compounds, low molecular weight polymers with cationic functional group, etc., can be used. In addition, as a charge control agent for negative charge toner, azo metal-containing complexes, salicylic acid metal complexes, boron complexes, low molecular weight polymers with anionic functional group, etc., can be used.

It is preferable that content of the charge control agent be 0.1 to 5 weight % to toner particle.

In the toner for electrophotography used in the two-component developer for electrolphotography of the present invention, magnetic powder may be contained in toner particle at 40 weight % or less to toner particle. As a magnetic powder, fine particles such as ferrite powder, magnetite powder, iron powder, etc., can be used. As a ferrite powder, mixed sintered compound of MeO—$Fe_2O_3$ can be used in the present invention. In this case, MeO indicates oxides of Mn, Zn, Ni, Ba, Co, Cu, Li, Mg, Cr, Ca, V, etc., and they can be used alone or in combination. In addition, as a magnetite powder, mixed sintered compound of FeO—$Fe_2O_3$ can be used. It is preferable that particle size of the magnetic powder be 0.05 to 3 μm.

The above material and other material used as necessary are mixed at a desired rate and the mixture is melt-kneaded, pulverized, and classified, and therefore, the toner for electrophotography used in the two-component developer for electrophotography of the present invention is produced. The toner particle may be produced by the above material using other granulation methods such as a suspension polymerization method, etc. It is preferable that the volume average particle diameter (volume 50% diameter measured by Coulter Multisizer II (produced by Coulter Electronics Ltd.)) of the toner particle be 7.0 to 11 μm, and it is more preferable that it be 7.5 to 9.5 μm. When the volume average particle diameter is not more than 7.0 μm, it is easy for the electrostatic charge to be inferior and for the toner dusting to be generated. In contrast, when it exceeds 11 μm, roughening of image is conspicuous and image quality is decreased. It is preferable that the volume average particle diameter be 7.5 to 9.5 μm in order to obtain clear images which are superior in resolution and which faithfully reproduce differences in light and shade.

In the toner for electrophotography used in the two-component developer for electrophotography of the present invention, it is preferable that magnetic powder be adhered to the surface thereof.

The magnetic powder has an effect of improving electrostatic charge increasing ability of the toner, and fogging at supplying toner can thereby be decreased.

As a magnetic powder, fine particles such as ferrite powder, magnetite powder, iron powder, etc., can be used. As a ferrite powder, mixed sintered compound of MeO—$Fe_2O_3$ can be used in the present invention. In this case, MeO indicates oxides of Mn, Zn, Ni, Ba, Co, Cu, Li, Mg, Cr, Ca, V, Pb, etc., and they can be used alone or in combination. In addition, as a magnetite powder, mixed sintered compound of FeO—$Fe_2O_3$ can be used. It is preferable that particle size of the magnetic powder be 0.05 to 3 μm. In addition, it is preferable that the magnetic powder be granular such as of a spherical shape, hexahedron, octahedron, polyhedron, etc.

It is preferable that adhered amount of magnetic powder to toner particle be 0.3 to 2.0 weight %, it is more preferable that it be 0.5 to 1.5 weight %, and it is most preferable that it be 0.6 to 1.0 weight %. When the adhered amount is not more than 0.3 weight %, effect of the electrostatic charge increasing ability is insufficient, and in contrast, when it exceeds 2.0 weight %, the magnetic powder falls off from the toner particle and adheres to the surface of a photoconductor, and as a result, black spots are generated.

In the present invention, in the case in which fluidity of the developer is inferior, it is preferable that silica fine particle be adhered to the surface of the toner particle in order to adjust the fluidity.

It is preferable that the adhered amount of the silica fine particle to the toner particle be 0.2 to 2.0 weight %, it is more preferable that it be 0.4 to 1.5 weight %, and it is most preferable that it be 0.6 to 1.0 weight %. When the adhered amount of the silica fine particle is not more than 0.2 weight %, it is easy for the toner to not be suitably supplied and storage stability is deteriorated, since the fluidity of the developer is only slightly improved. In contrast, when it exceeds 2.0 weight %, the silica fine particle easily falls off and there are problems in that film forming of photoconductor, black spot, carrier spent due to the silica fine particle, etc., are generated. It is preferable that volume average particle diameter of the silica fine particle be 10 to 40 nm. In addition, it is preferable that the silica be hydrophobic silica.

In the toner used in the two-component developer for electrophotography of the present invention, in addition to the magnetic powder and the silica fine particle, external additives such as inorganic fine particles such as alumina, talc, clay, calcium carbonate, magnesium carbonate, titania, zinc oxide, silicon carbide, zirconia; fatty acids metal salt such as magnesium stearate, zinc stearate; various resin fine particles; or the like, in order to control fluidity, charging ability, cleaning ability, storage stability of the toner, etc.

As a method for adhering the external additives such as magnetic powder and the silica fine particle to the toner particle, a method of mixing and stirring using a general stirring machine such as turbine stirring machine, Henshel mixer, super mixer, etc., can be mentioned.

EXAMPLES

In the following, the present invention will be explained in more detail by Examples. In Examples, "parts" means "weight parts". The present invention is not limited thereto.

1. Production of Resin Coated Carriers (1) Production of Carrier A

Straight silicone resin (trade name: SR 2410, produced by Dow Coning Toray Silicone Co., Ltd.) and acrylic resin (trade name: ACRYDIC, produced by Dainippon Ink and Chemicals, Inc.) were mixed so as to be 60:40 by weight ratio. The mixed resin was diluted in toluene, and a resin solution was prepared. Next, carbon black (trade name: BLACK PEARLS 2000, produced by Cabot Specialty Chemicals, Ltd.) was added to the resin solution so as to be 15 weight % to resin component of coating material, and coating material was produced by stirring using a mixer. 0.8 parts (as solid) of the coating material and 99.2 parts of magnesium ferrite ((Mg: 2.0 weight %, Fe: 60.2 weight %, Al: 0.1 weight %, Si: 0.5 weight %, Ca: 0.1 weight %, O: 37.1 weight %), volume average particle diameter: 70 μm, electric resistance: $3.4\times10^4$ Ω·cm, breakdown voltage: 150 V), were prepared. Next, using an apparatus based on a fluidizing bed method, the magnesium ferrite was held in a floating state in an air flow, and the coating material was adhered on the surface of the magnesium ferrite by spraying, so that the coated magnesium ferrite was produced in a tackfree state. Then, the resin was cured by heating at 150° C. for 1 hour.

Finally, carrier A of the present invention was produced by screening. In the carrier A, electric resistance was $3.4\times10^4$ Ω·cm, breakdown voltage was 150 V, volume average particle diameter was 70.1 μm.

(2) Production of Carriers B to I

Carriers B to E, H, and I of the present invention and Carriers F and G of comparative examples were produced in the same manner as that of Carrier A, except that mixing ratio of coating resin, content of conductive agent, covering amount of coating material was changed to those shown in Table 1. Electric resistance and breakdown voltage of each carrier are shown in Table 1.

TABLE 1

| Carrier | Mg Content (weight %) | Silicone Component:Acrylic Component | Conductive Agent Content (weight %) | Coating Material Coveing Amount (weight %) | Electric Resistance (Ω · cm) | Breakdown Voltage (V) |
|---|---|---|---|---|---|---|
| A | 2.7 | 60:40 | 18 | 0.8 | $3.0 \times 10^4$ | 150 |
| B | 2.7 | 60:40 | 24 | 0.8 | $4.6 \times 10^3$ | 130 |
| C | 2.7 | 60:40 | 12 | 0.8 | $8.5 \times 10^5$ | 250 |
| D | 2.7 | 80:20 | 12 | 0.4 | $1.2 \times 10^5$ | 180 |
| E | 2.7 | 60:40 | 24 | 1.2 | $4.1 \times 10^4$ | 130 |
| H | 2.7 | 100:0 | 18 | 0.8 | $2.8 \times 10^4$ | 140 |
| I | 2.7 | 0:100 | 18 | 0.8 | $3.6 \times 10^4$ | 160 |
| F | 2.7 | 60:40 | 5 | 0.8 | $1.3 \times 10^7$ | 370 |
| G | 2.7 | 60:40 | 28 | 0.8 | $0.4 \times 10^3$ | 110 |

2. Production of Toners (1) Production of Toner a 91 parts of styrene acrylic resin (trade name: ST-305, produced by Sanyo Chemical Industries, Ltd.), 2 parts of polypropylene wax (trade name: VISCOL 550P, melting point: 152° C., produced by Sanyo Chemical Industries, Ltd.), 6 parts of carbon black (trade name: REGAL 330R, produced by Cabot Specialty Chemicals, Inc.), and 1 part of charge control agent (trade name: S-44, produced by Hodogaya Chemical Co., Ltd.), were mixed for 10 minutes using a super mixer, were heat-kneaded by a biaxial extruder, were cooled, were pulverized by a jet mill, and were classified by a dry-type air flow classifier, and therefore, negative charge nonmagnetic toner particles having 8.5 μm of volume average particle diameter was produced. Then, magnetic powder (magnetite) (trade name: EPT-1000, octahedron, particle size: 0.30 μm, produced by Toda Kogyo K.K.) and hydrophobic silica (trade name: R-972, produced by Nippon Aerosil Co., Ltd.) were added so that each adhered amount to the toner particle was 0.8 weight % and 0.6 weight %, respectively, and therefore, toner a of the present invention was produced by mixing using a Henshel mixer.

(2) Production of Toner b

Toner b of the present invention was produced in the same manner as that of the toner a, except that added amount of magnetic powder was changed to 1.2 weight %. Volume average particle diameter of the toner b was 8.5 μm.

(3) Production of Toner c

Toner c of the present invention was produced in the same manner as that of the toner a , except that added amount of magnetic powder was changed to 0.4 weight %. Volume average particle diameter of the toner c was 8.5 μm.

(4) Production of Toner d

Toner d of the present invention was produced in the same manner as that of the toner a, except that magnetic powder was not added. Volume average particle diameter of the toner d was 8.5 μm.

3. Production of Two-component Developers

Two-component developers of Examples 1 to 10 and Comparative Examples 1 and 2 were produced by mixing 95 parts of carrier and 5 parts of toner according to combinations shown in Table 2 of the carriers A to I and the toners a to d.

TABLE 2

| | Carrier | Toner | Fogging at Supplying Toner | Fogging after Leaving |
|---|---|---|---|---|
| Example 1 | A | a | 0.81 | 0.67 |
| Example 2 | B | a | 0.63 | 1.09 |
| Example 3 | C | a | 1.05 | 0.56 |
| Example 4 | D | a | 0.97 | 0.72 |
| Example 5 | E | a | 0.80 | 0.89 |
| Example 6 | A | b | 0.59 | 0.95 |
| Example 7 | A | c | 0.91 | 0.62 |
| Example 8 | H | a | 1.52 | 0.66 |
| Example 9 | I | a | 0.70 | 1.56 |
| Example 10 | A | d | 1.28 | 0.88 |
| Comparative Example 1 | F | a | 1.76 | 0.62 |
| Comparative Example 2 | G | a | 0.51 | 1.88 |

4. Evaluation of Developers

The following evaluations were carried out at 25° C. and 50% RH.

(1) Fogging at Supplying Toner

The above developers of Examples and Comparative Examples were printed by a printer using negative charge two-component developer (printing speed: 18 sheets per minute), and in each case, fogging at supplying toner was measured.

The fogging at supplying toner was measured by printing white solid image on the eleventh sheet after black solid image was continuously printed on 10 sheets of A4 size, so as to compulsorily supply the toner. Here, differences between whiteness of a non-image portion on transfer paper after printing and whiteness of transfer paper before printing was measured as a value of fogging, using a whiteness measuring apparatus (trade name: MODEL Z-1001DP, produced by Nippon Denshoku Industries Co., Ltd.). The results are shown in Table 2.

(2) Fogging after Leaving

The above developers of Examples and Comparative Examples were left for 1 month, and the developers were printed by a printer using negative charge two-component developer (printing speed: 18 sheets per minute), and in each case, fogging after leaving of the first sheet was measured. In measurement of fogging after leaving, replacement of the developer was carefully carried out so as not to give external force such as vibration to the developer, and the printing was carried out so as to decrease stirring in a developing unit-as little as possible, without initial setting the evaluating printer. The measuring method of the fogging is the same as that of the above fogging at supplying toner. The results are shown in Table 2.

5. Evaluated Results

There is no problem in practical use, if the fogging is 1.5 or less, and as is apparent from Table 2, in the two-component developer for electrophotography of Example 8, fogging at supplying toner was slightly generated since acrylic component was not contained in carrier coating material, in the two-component developer for electrophotography of Example 9, fogging after leaving was slightly generated since silicone component is not contained in carrier coating material, and in the two-component developer for electrophotography of Example 10, fogging at supplying toner was slightly generated since magnetic powder was not adhered to toner; however, in the two-component developers for electrophotography of Examples 1 to 7, both of fogging at supplying toner and fogging after leaving were superior.

In contrast, in the two-component developer for electrophotography of Comparative Example 1, fogging at supplying toner was generated since electric resistance of the carrier is high and electrostatic charge increasing ability of the toner is inferior. In addition, in the two-component developer for electrophotography of Comparative Example 2, fogging after leaving was generated since electric resistance of the carrier is low and electrostatic charge maintaining ability is inferior.

What is claimed is:

1. A resin coated carrier for electrophotography comprising: a coating material and a core material, wherein the coating material covers the surface of the core material such that the coating amount of the coating material is 0.3 to 1 .5 weight % to the total resin coated carrier, the coating material contains a silicone component and an acrylic component as a resin component, the core material consists of magnesium ferrite having a content of magnesium element of 0.5 to 10 weight %, and the electric resistance of the carrier at applied voltage of 100 V is $1.0\times10^3$ to $1.0\times10^6$ Ω·cm, and breakdown voltage is 120 to 280 V.

2. A two-component developer for electrophotography comprising the resin coated carrier for electrophotography according to claim 1 and toner which contains at least binder resin and colorant.

3. A two-component developer for electrophotography according to claim 2, wherein the toner is a toner for electrophotography in which magnetic powder is adhered to the surface of particles thereof.

* * * * *